US007574162B2

(12) United States Patent
Yamane

(10) Patent No.: US 7,574,162 B2
(45) Date of Patent: Aug. 11, 2009

(54) TONER CONTAINER, AND IMAGE FORMING APPARATUS

(75) Inventor: Masayuki Yamane, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 148 days.

(21) Appl. No.: 11/538,694

(22) Filed: Oct. 4, 2006

(65) Prior Publication Data

US 2007/0086809 A1 Apr. 19, 2007

(30) Foreign Application Priority Data

Oct. 18, 2005 (JP) ..... 2005-302594

(51) Int. Cl.
*G03G 15/08* (2006.01)

(52) U.S. Cl. ..... 399/258; 399/262

(58) Field of Classification Search ..... 399/224, 399/256, 258, 260, 262, 263
See application file for complete search history.

(56) References Cited

U.S. PATENT DOCUMENTS 5,909,609 A * 6/1999 Yahata et al. ..... 399/258
2006/0099012 A1 5/2006 Kita et al.

FOREIGN PATENT DOCUMENTS

| | | |
|---|---|---|
| JP | 10-48931 | 2/1998 |
| JP | 2001-154487 | 6/2001 |
| JP | 2002-287497 | 10/2002 |
| JP | 2004-287404 | 10/2004 |
| JP | 2006-47811 | 2/2006 |
| JP | 2006/58698 | 3/2006 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A toner container includes a container member with a spiral member therein that contains toner and conveys the toner toward an opening in conjunction with a rotation of the spiral member. A toner supply device includes a conveyor tube through which the toner discharged from the toner container is conveyed with gas, and a screw pump that sends gas into and evacuates gas from the conveyor tube.

15 Claims, 7 Drawing Sheets

| K | 2.4 | 2.8 | 3.2 | 3.6 | 4.0 | 4.4 |
|---|---|---|---|---|---|---|
| VARIATION IN TONER SUPPLY AMOUNT | POOR | AC-CEPT-ABLE | GOOD | GOOD | AC-CEPT-ABLE | POOR |

TONER CONTAINER, AND IMAGE FORMING APPARATUS

CROSS-REFERENCE TO RELATED APPLICATIONS

The present document incorporates by reference the entire contents of Japanese priority document, 2005-302594 filed in Japan on Oct. 18, 2005.

BACKGROUND OF THE INVENTION

1. Field of the Invention

The present invention relates to a toner container that is removably mounted on an image forming apparatus for supplying toner consumed in image forming process, and the image forming apparatus.

2. Description of the Related Art

An electrophotographic image forming apparatus such as a copier, printer, facsimile, or multifunction product has been using a toner supply devise with a screw pump (a uniaxial eccentric screw pump or mohno pump) for delivering toner in a toner container to a developing device.

For example, Japanese Patent Application Laid-Open No. 2002-287497 discloses a toner supply devise. A bag-shaped toner container is removably mounted on an image forming apparatus, and connected to a tube (conveyor tube) via a nozzle. The tube has one end connected to a screw pump. The screw pump includes a rotor, a stator, a suction opening, a universal joint, and a motor. The rotor in the stator is rotatingly driven by the motor in a predetermined direction to cause a negative pressure (suction pressure) in the tube. Accordingly, toner is discharged from the toner container, and moves through the tube. The toner is sucked by the suction opening of the screw pump, sent into a space between the stator and the rotor, and is then carried to the other end side along the rotation of the rotor. The toner is discharged from an outlet of the screw pump, and supplied to a developing device.

The conventional toner supply device is formed of the toner container, the developing device, and the flexible tube serving as a toner supply path therebetween, and therefore, flexibility in layout of the entire image forming apparatus is increased. That is, the toner supply device with a screw pump conveys toner by generating pressure (negative pressure or positive pressure) in the flexible tube, which allows relatively free design of layout for the toner container, the developing device, and the toner supply path. Thus, the image forming apparatus can be downsized.

Besides, for example, Japanese Patent Application Laid-Open No. 2004-287404 discloses a cylindrical toner container with a spiral protrusion arranged on its inner surface. The toner container (toner bottle) replaceably mounted on a toner supply device of an image forming apparatus mainly includes a container portion and a held portion (cap). The container portion contains toner and includes a spiral protrusion on the inner surface. The container portion is rotatingly driven so that the toner is conveyed toward an opening thereof. The held portion is communicated with the opening and includes a toner outlet. The toner sent from the opening is discharged through the toner outlet. The toner is then supplied to a developing device via a toner conveyor pipe with a coil therein.

The conventional image forming apparatus, however, when used under a high-temperature and high-humidity environment, sometimes causes toner blocking in the tube (the tube is clogged with toner) due to a decrease in fluidity of toner moving through the tube (toner conveying ability). The toner blocking causes an insufficient toner supply to the developing device, and density on an output image is lowered. Additionally, such an insufficient supply of toner, which serves as a lubricant between the rotor and the stator of the screw pump, causes the stator to be worn out, leading to a failure in the toner supply device.

SUMMARY OF THE INVENTION

It is an object of the present invention to at least partially solve the problems in the conventional technology.

According to an aspect of the present invention, an image forming apparatus includes a toner supply device that conveys toner to a conveyance destination. The toner supply device includes a toner container that includes a container member with a spiral member therein and an opening, and conveys toner contained in the container member toward the opening in conjunction with a rotation of the spiral member, a conveyor tube through which the toner discharged from the toner container is conveyed with gas, and a screw pump that sends the gas into and evacuates the gas from the conveyor tube.

According to another aspect of the present invention, a toner container that is removably mounted on a toner supply device of an image forming apparatus, includes a container member that includes a spiral member and an opening, and conveys toner contained therein toward the opening in conjunction with a rotation of the spiral member. The toner supply device includes a conveyor tube through which the toner discharged from the toner container is conveyed with gas, and a screw pump that sends gas into and evacuates gas from the conveyor tube.

According to still another aspect of the present invention, an image forming apparatus includes toner supply means for conveying toner to a conveyance destination. The toner supply means includes toner containing means, including a container member with a spiral member therein and an opening, for conveying toner contained in the container member toward the opening in conjunction with a rotation of the spiral member, conveyor tube means for conveying the toner discharged from the toner container with gas, and screw pump means for sending the gas into and evacuating the gas from the conveyor tube means.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
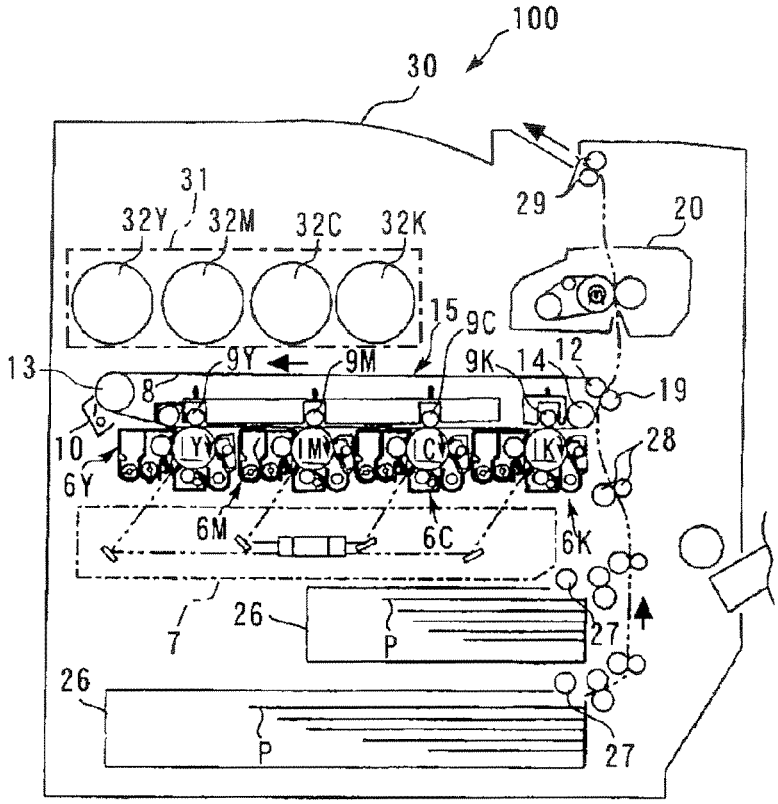
FIG. 1 is a schematic of an image forming apparatus according to an embodiment of the present invention.

Exemplary embodiments of the present invention are described in detail below with reference to the drawings. Like reference numerals refer to corresponding parts throughout the drawings, and the similar description is not repeated.

First, with reference to FIGS. 1 to 4, the entire operation and configuration of an image forming apparatus is described.

Figure 2:
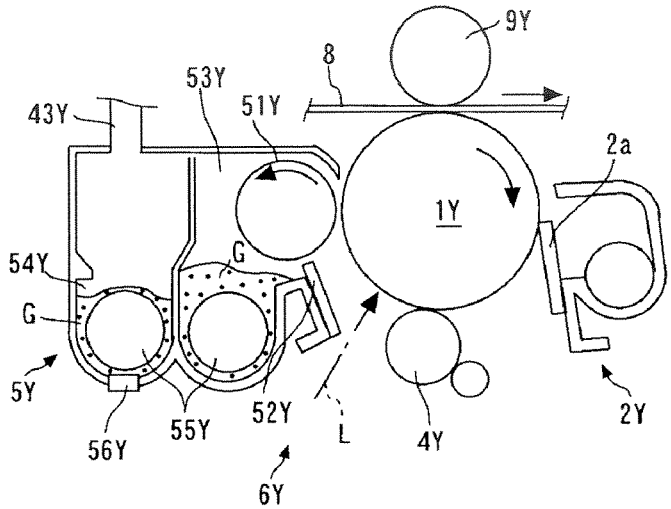
FIG. 2 is a section of an image forming unit shown in FIG. 1.
Figure 3:
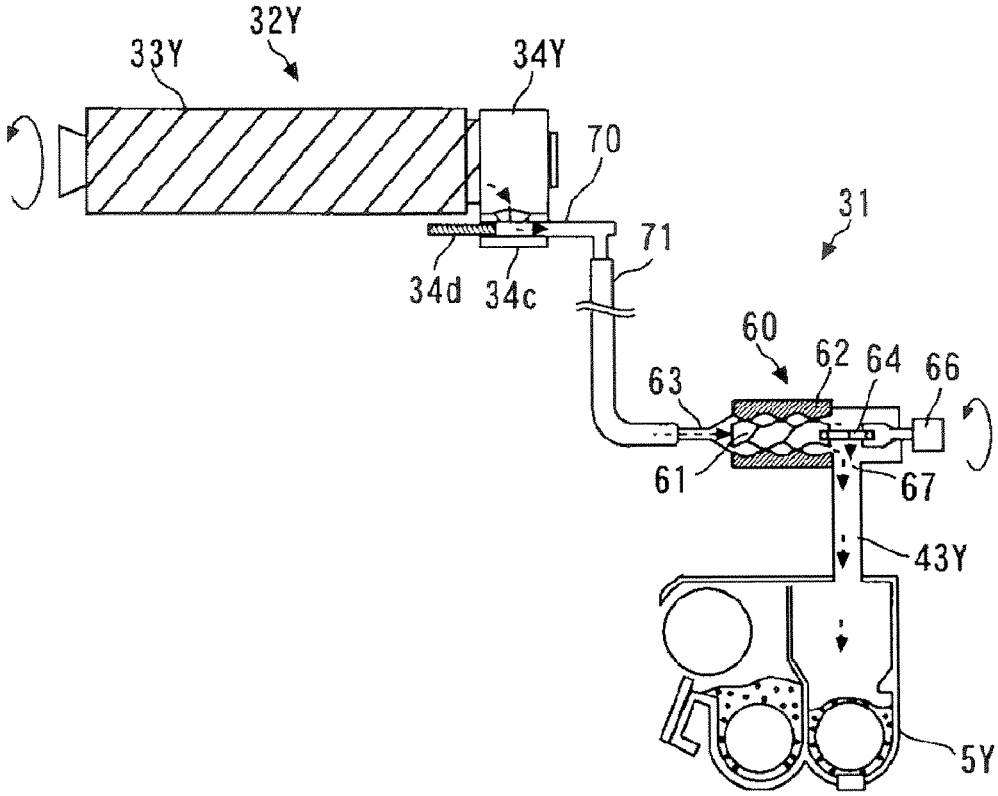
FIG. 3 is a schematic of a toner supply path in the image forming apparatus shown in FIG. 1.
Figure 4:
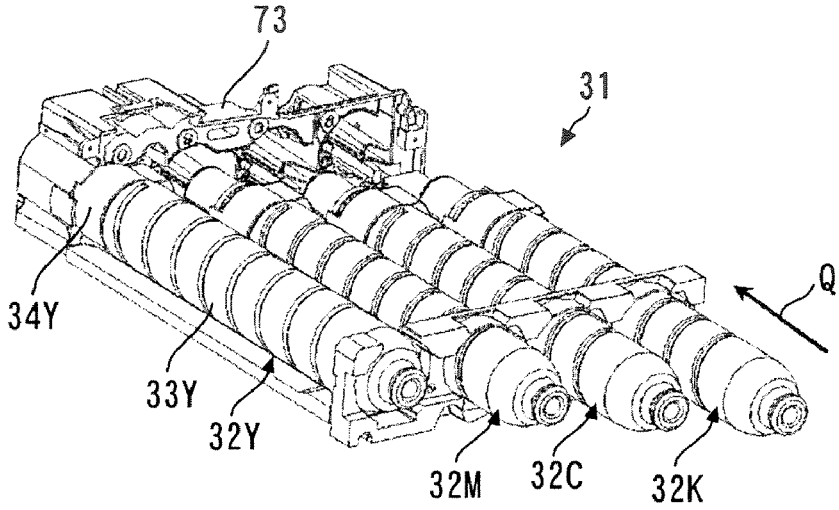
FIG. 4 is a partial perspective view of a toner supply device with toner containers shown in FIG. 1.

FIG. 1 is a schematic of a printer as an image forming apparatus 100. FIG. 2 is an enlarged view of an image forming unit in the image forming apparatus 100. FIG. 3 is a schematic of a toner supply path in the image forming apparatus 100. FIG. 4 is a partial perspective view of a toner supply device.

The image forming apparatus 100 includes a toner supply device 31, which has four toner containers 32Y, 32M, 32C, and 32K corresponding to colors (yellow, magenta, cyan, and black, respectively) removably mounted thereon to be easily replaced.

Under the toner supply device 31 is arranged an intermediate transfer unit 15. The intermediate transfer unit 15 has an intermediate transfer belt 8, which faces image forming units 6Y, 6M, 6C, and 6K that are arranged in line correspondingly to the colors (yellow, magenta, cyan, and black, respectively).

With reference to FIG. 2, the image forming unit 6Y corresponding to yellow includes a photosensitive drum 1Y, a charging unit 4Y set around the photosensitive drum 1Y, a developing device 5Y (developing unit), a cleaning unit 2Y, a static eliminating unit (not shown), and other components. On the photosensitive drum 1Y, image forming processes (a charging process, an exposing process, a developing process, a transferring process, and a cleaning process) are preformed to form a yellow image on the photosensitive drum 1Y.

The image forming units 6Y, 6M, 6C, and 6K are of like configuration, except for toner color and image color corresponding to the toner color, and thus one of them, the image forming unit 6Y corresponding to yellow, is described below.

With reference to FIG. 2, the photosensitive drum 1Y rotatingly driven by a driving motor not shown in a clockwise direction in FIG. 2. Then, at the position of the charging unit 4Y, the surface of the photosensitive drum 1Y is uniformly charged (this is a charging process).

The surface of the photosensitive drum 1Y then reaches a position where the surface is to be irradiated with laser light L emitted from an exposing unit 7 (as shown in FIG. 1). Through exposure scanning at this position, an electrostatic latent image corresponding to yellow is formed (exposing process).

The surface of the photosensitive drum 1Y then reaches a position facing the developing device 5Y. At this position, the electrostatic latent image is developed to form a toner image for yellow (developing process).

The surface of the photosensitive drum 1Y then reaches a position facing the intermediate transfer belt 8 and a primary transfer bias roller 9Y. At this position, the toner image on the photosensitive drum 1Y is transferred to the intermediate transfer belt 8 (primary transfer process). At this time, untransferred toner, although slight, is left on the photosensitive drum 1Y.

The surface of the photosensitive drum 1Y then reaches a position facing the cleaning unit 2Y. At this position, the untransferred toner left on the photosensitive drum 1Y is mechanically collected by a cleaning blade 2*a* (cleaning process).

Finally, the surface of the photosensitive drum 1Y reaches a position facing the static eliminating unit not shown. At this position, a residual potential on the photosensitive drum 1Y is removed.

In this manner, a series of image forming processes performed on the photosensitive drum 1Y is completed.

The image forming processes described above are performed in the other image forming units 6M, 6C, and 6K in a similar manner as that in the yellow image forming unit 6Y. That is, the laser light L based on image information is emitted from the exposing unit 7 below the image forming units toward the photosensitive drum of each of the image forming units 6M, 6C, and 6K. Specifically, the exposing unit 7 emits the laser light L from a light source, and performs scanning with the laser light L while a polygon mirror is being rotatingly driven, thereby irradiating the photosensitive drum via a plurality of optical elements.

The toner images of the respective colors formed on the photosensitive drums after the developing process are then transferred onto the intermediate transfer belt 8 to be superimposed on one another. Thus, a color image is formed on the intermediate transfer belt 8.

With reference to FIG. 1, the intermediate transfer unit 15 includes the intermediate transfer belt 8, four primary transfer bias rollers 9Y, 9M, 9C, and 9K, a secondary transfer backup roller 12, a cleaning backup roller 13, a tension roller 14, an intermediate transfer cleaning unit 10, and other components. The intermediate transfer belt 8 is supported and stretched by three rollers 12 to 14, and is also moved by rotational driving of the secondary transfer backup roller 12 in a direction represented by an arrow in FIG. 1.

The four primary transfer bias rollers 9Y, 9M, 9C, and 9K each have the intermediate transfer belt 8 interposed with the relevant one of the photosensitive drums 1Y, 1M, 1C, and 1K to form a primary transfer nip. Then, a transfer bias reverse to the polarity of the toner is applied to the primary transfer bias rollers 9Y, 9M, 9C, and 9K.

The intermediate transfer belt 8 then runs in a direction represented by an arrow to sequentially pass through primary transfer nips of the primary transfer bias rollers 9Y, 9M, 9C, and 9K. Thus, the toner images of the respective colors on the photosensitive drums 1Y, 1M, 1C, and 1K are superposed on the intermediate transfer belt 8 for primary transfer.

The intermediate transfer belt 8 having the toner image of the respective colors superposed thereon for transfer then reaches a position facing a secondary transfer roller 19. At this position, the secondary transfer backup roller 12 has the intermediate transfer belt 8 interposed with the secondary transfer roller 19 to form a secondary transfer nip. The toner image of four colors formed on the intermediate transfer belt 8 is then transferred on a transfer material P, such as a transfer sheet, conveyed at the position of the secondary transfer nip. At this time, untransferred toner not transferred onto the transfer material P is left on the intermediate transfer belt 8.

The intermediate transfer belt 8 then reaches the position of the intermediate transfer cleaning unit 10. At this position, the untransferred toner on the intermediate transfer belt 8 is collected.

In this manner, a series of transfer processed performed on the intermediate transfer belt 8 is completed.

The transfer material P conveyed to the position of the secondary transfer nip is from a paper feeding unit 26 under the image forming apparatus 100 via a paper feeding roller 27 and paired resist rollers 28, for example.

Specifically, the paper feeding unit 26 has accommodated therein a stack of sheets of the transfer material P, such as transfer paper. When the paper feeding roller 27 is rotatingly driven in a counterclockwise direction in FIG. 1, a sheet of the transfer material P on top is supplied between the paired resist rollers 28.

The transfer material P conveyed by the paired resist rollers 28 is temporarily stopped at a position of a roller nip of the paired resist rollers 28 stopping its rotational driving. Then, according to the timing of the color image on the intermediate transfer belt 8, the paired resist rollers 28 are again rotatingly driven, and then the transfer material P is conveyed toward the secondary transfer nip. In this manner, a desired color image is transferred onto the transfer material P.

The transfer material P with the color image transferred at the position of the secondary transfer nip is then conveyed to the position of a fixing unit 20. At this position, the color image transferred onto the surface of the transfer material P is fixed thereon by heat and pressure from a fixing roller and a pressure roller.

The transfer material P is then delivered to a gap between paired paper delivery rollers 29, and then to the outside of the apparatus. The transfer material P delivered by the paired paper delivery rollers 29 to the outside of the apparatus is sequentially stacked on a stacking unit 30 as an output image.

In this manner, a series of image forming processes in the image forming apparatus is completed.

Next, with reference to FIG. 2, the configuration and operation of the developing device 5Y is described in more detail.

The developing device 5Y includes a developing roller 51Y, a doctor blade 52Y facing the developing roller 51Y, two conveyor screws 55Y in developer containers 53Y and 54Y, a density detection sensor 56Y that detects a toner density of a developer, and other components. The developing roller 51Y includes a magnet fixedly provided therein, a sleeve rotating about the magnet, and other components. The developer containers 53Y and 54Y each containing therein a two-component developer G composed of carrier and toner. The developer container 54Y has an opening on its upper portion, which is communicated with a toner conveyor tube 43Y.

The developing device 5Y configured as described above operates as follows.

The sleeve of the developing roller 51Y rotates in a direction represented by an arrow in FIG. 2. With a magnetic field formed by the magnet, the developer G carried on the developing roller 51Y is moved on the developing roller 51Y according to the rotation of the sleeve.

The developer G in the developing device 5Y has a ratio of the toner (toner density) in the developer being adjusted within a predetermined range. Specifically, depending on tone consumption in the developing device 5Y, the toner in the toner container 32Y is supplied via the toner supply device 31 to the developer container 54Y. The configuration and operation of the toner supply device 31 and the toner container 32Y will be described in detail below.

The toner supplied to the developer container 54Y is then circulated through two developer containers 53Y and 54Y while being mixed an agitated by two conveyor screws 55Y with the developer G (in a portrait direction in FIG. 2). The toner in the developer G is then absorbed to the carrier due to frictional electrification with the carrier, and is carried on the developing roller 51Y with the carrier by magnetic force formed on the developing roller 51Y.

The developer G carried on the developing roller 51Y is conveyed in a direction represented by an arrow in FIG. 2 to reach the position of the doctor blade 52Y. Then after the amount of the developer G on the developing roller 51Y is adjusted at this position to an appropriate amount, the developer G is conveyed to a position (developing area) facing to the photosensitive drum 1Y. With an electric field formed in the developing area, the toner is absorbed onto the latent image formed on the photosensitive drum Y1. The developer G left on the developing roller 51Y then reaches an upper portion of the developer container 53Y according to the rotation of the sleeve and, at this position, is separated from the developing roller 51Y.

Next, with reference to FIG. 3 the toner supply device 31 that introduces the toner in the toner container 32Y to the developing device 5Y is described in detail.

In FIG. 3, for a better understanding, the toner container 32Y, the toner conveyor tube 43Y, components in the toner supply device, and the developing device 5Y are depicted with their arrangement directions being changed. In practice, in FIG. 3, longitudinal directions of the toner container 32Y and part of the toner supply path are identical to a portrait direction of the drawing (as shown in FIG. 1).

With reference to FIG. 4, according to toner consumption in the developing device for each color, the toner in each of the toner containers 32Y, 32M, 32C, and 32K mounted on the toner supply device 31 of the image forming apparatus 100 is supplied to each developing device as appropriate via the toner supply path provided for each toner color. Four toner supply paths have an approximately identical configuration except for a different toner color for use in an image forming process.

When the toner container 32Y is set in the toner supply device 31 of the image forming apparatus 100, a nozzle 70 of the toner supply device 31 is connected to a held portion 34Y of the toner container 32Y. At this time, a plug member 34*d* (opening-and-closing member) of the toner container 32Y opens the toner outlet of the held portion 34Y. Thus, the toner in a container portion 33Y of the toner container 32Y is conveyed through the toner outlet into one end of the nozzle 70.

On the other hand, the other end of the nozzle 70 has connected thereto an end of a tube 71 as a conveyor tube. The tube 71 is made of an excellent toner-resistant, flexible material, and has the other end connected to a screw pump 60 (mohno pump) of the toner supply device.

The tube 71 as a carrier tube is formed to have an inner radius of 4 millimeters to 10 millimeters. Examples of the material for the tube 71 include rubber materials, such as polyurethane, nitrile, ethylene propylene dien monomer (EPDM), and silicon, and resin materials, such as polyethylene and nylon. By using such the tube 71, flexibility in layout of the toner supply path can be increased, which downsizes the image forming apparatus.

The screw pump 60 is a suction uniaxial eccentric screw pump, and includes a rotor 61, a stator 62, a suction opening 63, a universal joint 64, a motor 66, and other components. The rotor 61, the stator 62, and the universal joint 64, for example, are accommodated in a case (not shown). The stator 62 is a female-thread-shaped member made of an elastic material, such as rubber, and has formed therein a spiral groove with a double pitch. The rotor 61 is a male-thread-shaped member formed such that its shaft made of a rigid material, such as a metal, is twisted in a spiral shape, and rotatably fits in the stator 62. The rotor 61 has one end rotatably connected to the motor 66 via the universal joint 64.

In the embodiment, the spiral direction (winding direction) of the rotor 61 and its rotating direction are set to coincide with the spiral direction (winding direction) of a protrusion (spiral member) 33*b* formed on the container portion 33Y of the toner container 33Y and its rotating direction. This will be described in detail further below.

In the screw pump 60, the rotor 61 in the stator 62 is rotatingly driven by the motor 66 in a predetermined direction (in a counterclockwise direction when viewed from an upstream in a toner conveying direction), which causes a suction force at the suction opening 63 (causing a negative pressure in the tube 71 by evacuating gas in the tube 71). Accordingly, the toner in the toner container 32Y as well as the gas is sucked to the suction opening 63 via the tube 71. The toner sucked to the suction opening 63 is sent to a gap between the stator 62 and the rotor 61, and is further sent to the other end along the rotation of the rotor 61. The sent toner is delivered from a delivery opening 67 of the screw pump 60 to be supplied to the developing device 5Y via the toner conveyor tube 43Y (in a direction represented by broken arrows in FIG. 3).

In the embodiment, the rotor 61 of the screw pump 60 is rotated in the counterclockwise direction when viewed from the upstream in the toner conveying direction. Also, the spiral direction (winding direction) of the rotor 61 is set as a right-handed direction. Thus, with the rotation of the rotor 61, a vortex flow in a right-handed direction is formed in the screw pump 60.

Figure 5:
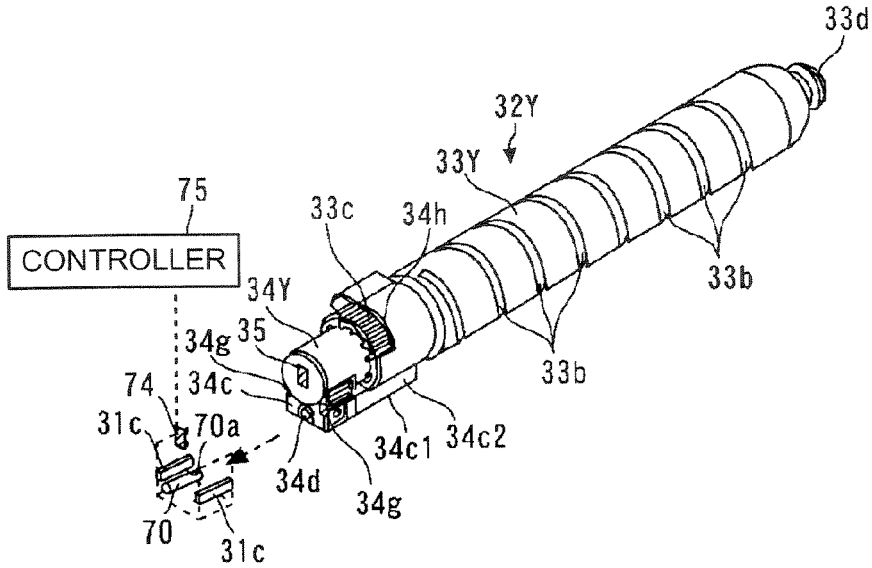
FIG. 5 is a perspective view of one of the toner containers shown in FIG. 4.
Figure 6:
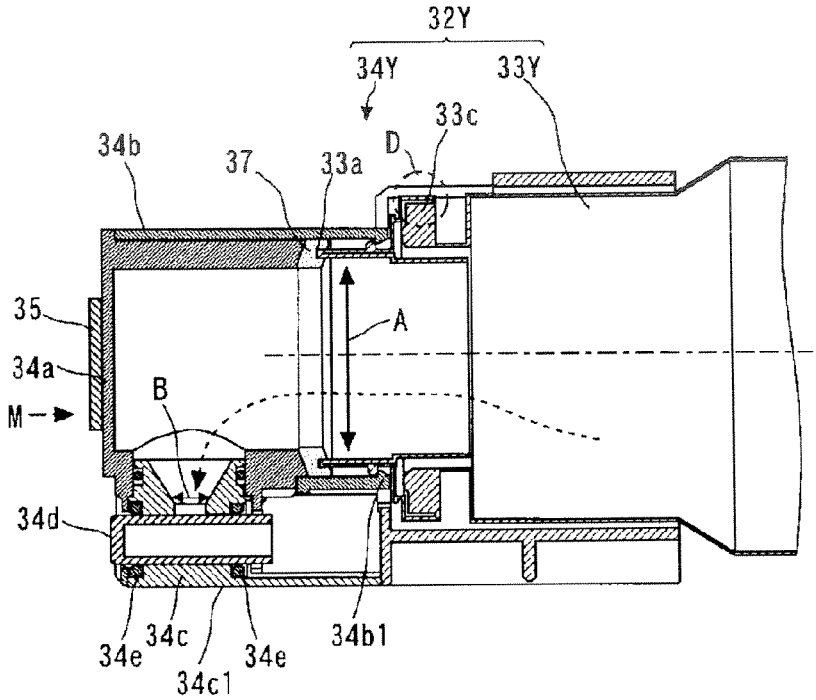
FIG. 6 is a section of a head side of the toner container shown in FIG. 5.
Figure 7:
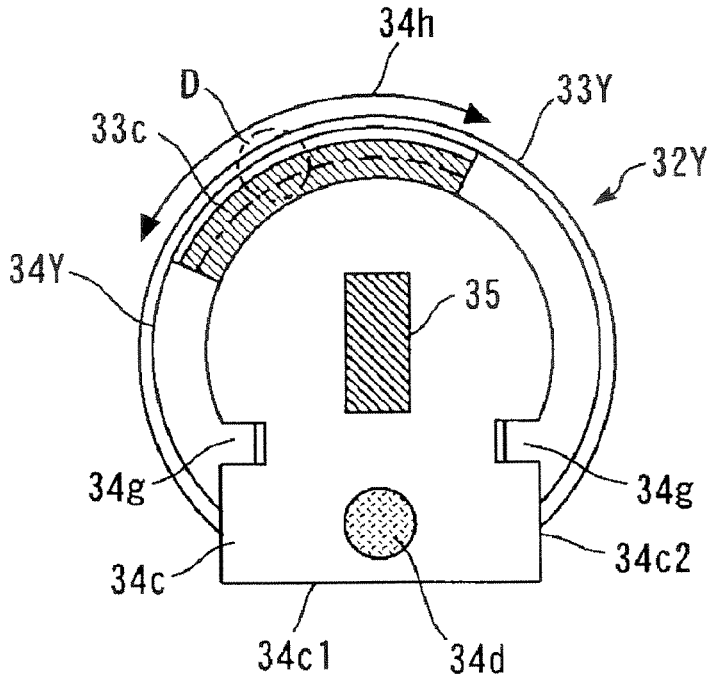
FIG. 7 is a front view of the toner container of FIG. 6 viewed in a direction M.

Next, with reference to FIGS. 5 to 7, the toner container is described.

As has been described with reference to FIGS. 1 and 4, the toner supply device 31 has four toner containers 32Y, 32M, 32C, and 32K (toner bottles) in an approximately cylindrical shape removably mounted therein. When the life of each of the toner containers 32Y, 32M, 32C, and 32K ends (when the toner has been almost completely consumed and the container is empty), the container is replaced by a new one. The toner of the relevant color in each of the toner containers 32Y, 32M, 32C, and 32K is supplied via the toner supply path described with reference to FIG. 3 to the developing device in the relevant one of the image forming units 6Y, 6M, 6C, and 6K as appropriate.

FIG. 5 is a perspective view of the toner container 32Y. FIG. 6 is a section of a head side of the toner container 32Y (in the case where the held portion 34Y is mounted). FIG. 7 is a front view of the toner container 32Y of FIG. 6 viewed in a direction M.

The toner containers 32Y, 32M, 32C, and 32K are of like configuration, except for the color of toner therein, and thus one of them, the toner container 32Y with yellow toner is mainly described.

As shown in FIG. 5, the toner container 32Y mainly includes the container portion 33Y and the held portion 34Y (bottle cap) on its head.

The container portion 33Y includes a gear 33*c* integrally rotated with the container portion 33Y, and an opening A at the head (as shown in FIG. 6). The opening A is located at the head of the container portion 33Y (a position serving as a head for a mounting operation) to deliver the toner in the container portion 33Y toward a space (hollow) in the held portion 34Y.

The gear 33*c* engages with a driving gear (not shown) of a driving unit in the toner supply device 31 of the image forming apparatus 100 to rotatingly drive the container portion 33Y about a rotation axis (represented by a one-dot-chain line in FIG. 6). Specifically, the gear 33*c* is exposed from a sectioned portion 34*h* formed on the held portion 34Y, and engages with the driving gear of the image forming apparatus 100 at an engaging position D shown in FIGS. 6 and 7.

With reference to FIG. 5, the container portion 33Y includes at the rear end portion (bottom portion) with a grip portion 33*d* to be gripped by the user for removing or attaching the toner container 32Y.

Also, the container portion 33Y includes the spiral protrusion 33*b* (spiral member) on an inner circumferential surface (a spiral groove when viewed from an outer circumferential surface side). This spiral protrusion 33*b* is to rotatingly drive the container portion 33Y in a predetermined direction to deliver the toner from the opening A. The container portion 33Y configured as described above can be manufactured with the gear 33*c* around its circumferential surface through blow molding.

In the embodiment, the spiral direction (winding direction) of the protrusion (spiral member) 33*b* formed on the container portion 33Y and its rotating direction are set to coincide with the spiral direction (winding direction) of the rotor 61 and its rotating direction in the screw pump 60.

Also, in the embodiment, the container portion 33Y of the toner container 32Y is rotated in the counterclockwise direction when viewed from the upstream in the toner conveying direction. Also, the spiral direction (winding direction) of the protrusion (spiral member) 33*b* in the container portion 33Y is set as a right-handed direction. Thus, with the rotation of the container portion 33Y, a vortex flow in a right-handed direction is formed in the toner container 32Y (this direction is identical to the rotating direction of the vortex flow formed in the screw pump 60).

With reference to FIGS. 5 and 6, the held portion 34Y includes a cap 34*a*, a cap cover 34*b*, a holder 34*c*, the plug member 34*d* as an opening-and-closing member, gaskets 34*e*, an identification (ID) chip 35, and other components. Also, with reference to FIGS. 5 and 7, the held portion 34Y includes, at both sides, engaging portions 34*g* (groove portion) with which a positioning member 31*c* of the toner supply device 31 engages. The held portion 34Y also includes an upper portion with the sectioned portion 34*h* from which part of the gear 33*c* is exposed.

The held portion 34Y is communicated with the container portion 33Y via the opening A, and delivers the toner discharged from the opening A to a toner outlet B (in a direction represented by a broken arrow in FIG. 6).

In the embodiment, the hollow (space) formed inside the held portion 34Y is formed in an approximately cylindrical shape (the upper portion of the held portion 34Y is formed in an approximately cylindrical shape). Thus, the vortex flow generated in the container portion 33Y due to the rotation of the container portion 33Y is maintained without being lost even in the held portion 34Y, and is efficiently sent to the toner outlet B located below. Therefore, the ability of conveying the toner discharged from the toner outlet B and moving through the tube 71 is increased.

Besides, in the embodiment, a toner delivery path (vertical path) from the hollow in an approximately cylindrical shape to the toner outlet B formed inside of the held portion 34Y is formed in a mortar shape. With this, the vortex flow generated in the container portion 33Y due to the rotation of the container portion 33Y is maintained without being lost, and is efficiently passed toward the toner outlet B. Therefore, the ability of conveying the toner discharged from the toner outlet B and moving through the tube 71 is increased.

Figure 8:
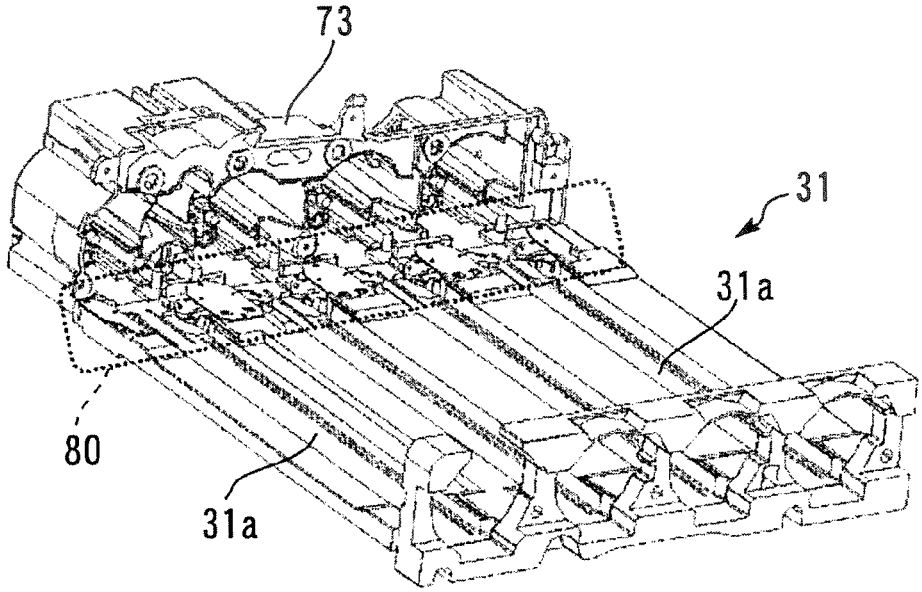
FIG. 8 is a partial perspective view of the toner supply device without the toner containers mounted thereon.

The held portion 34Y is not in conjunction with the rotation of the container portion 33Y, but is unrotatably held by a holding portion 73 of the toner supply device 31 (as shown in FIGS. 4 and 8), with the engaging portion 34*g* engaging with the positioning member 31*c*.

The cap cover 34*b* of the held portion 34Y is adhered to the circumferential surface of the cap 34*a*. The cap cover 34*b* has a tip with a nail 34*b*1. With this nail 34*b*1 engaging with an engaging portion formed at the head of the container portion 33Y, the container portion 33Y is rotatably held with respect to the held portion 34Y. For smooth rotational driving of the container portion 33Y, the nail 34*b*1 of the held portion 34Y and the engaging portion of the container portion 33Y are engaged with each other with an appropriate clearance therebetween.

The held portion 34Y has a sealing member 37 adhered to an opposed surface facing a tip surface 33*a* around the opening A of the container portion 33Y. The sealing member 37 is to seal a gap between opposed surfaces of the container portion 33Y and the held portion 34Y around the opening A, and is made of an elastic member, such as foamed polyurethane.

The held portion 34Y includes, at its lower portion, the holder 34*c*. The holder 34*c* has the plug member 34*d* (shutter) as an opening-and-closing member for opening and closing the toner outlet B in conjunction with an operation of attaching or removing the toner container 32Y. The plug member 34*d* has the gasket 34*e* at both ends, such as a G seal, for suppressing leakage of the toner near the plug member 34*d*. Although not shown in the drawings, when the toner container 32Y is set in the toner supply device 31, a lever (pressing portion) that presses the plug member 34*d* in a direction of closing the toner outlet B engages with a right end of the plug member 34*d*.

At an engaging portion between the holder 34*c* and the cap 34*a*, a gasket, such as an O ring, is mounted for suppressing leakage of the toner from a gap therebetween.

The ID chip 35 of the held portion 34Y is opposed to and spaced a predetermined distance from a substrate 74 of the toner supply device 31, in conjunction of an operation of attaching and removing the toner container 32Y to and from the toner supply device 31. Specifically, the ID chip 35 is on a plane of the held portion 34Y orthogonal to an attaching and removing direction (represented by an arrow in FIG. 5) with respect to the toner supply device 31, and is mounted at a position facing the substrate 74 in an attaching and removing operation.

The ID chip 35 has previously stored therein various information associated with the toner container 32Y. On the other hand, the substrate 74 of the toner supply device 31 wirelessly transmits and receives information with the ID chip 35, with the toner container 32Y being set in the toner supply device 31. That is, the information stored in the ID chip 35 is transmitted to a controller 75 (as shown in FIG. 5) of the image forming apparatus 100 via the substrate 74, or the information of the image forming apparatus 100 obtained from the controller 75 is transmitted and stored to the ID chip 35 via the substrate 74.

The ID chip 35 has stored therein information associated with toner, such as toner color, toner production number (production lot), and date of production, and information associated with recycling of the toner container 32Y, such as the number of times of recycling, date of recycling, and recycling company. When the toner container 32Y is mounted on the toner supply device 31, the information stored in the ID chip 35 is transmitted via the substrate 74 to the controller 75 of the image forming apparatus 100. Based on the information, the image forming apparatus 100 is appropriately controlled. For example, when the toner color is different from the one that is supposed to be mounted on the toner supply device, the operation of the toner supply device can be terminated. In another example, image forming conditions can be changed depending on the production number or the recycling company.

The holder 34*c* of the held portion 34Y includes sliding portions 34*c*1 and 34*c*2 that slides the toner supply device 31 in conjunction with the attaching and removing operation on the toner supply device 31.

Specifically, the first sliding portion 34*c*1 is a flat portion in parallel to a sliding surface 31*a* (upper surface, as shown in FIG. 3) of the toner supply device 31, and is arranged on the bottom portion of the held portion 34Y where an attaching and removing operation is performed. Also, the second sliding unit 34*c*2 is a flat portion in parallel to a sliding surface (side surface) of the toner supply device 31, and is arranged on the side portion of the held portion 34Y where an attaching and removing operation is performed.

In the embodiment, as the toner in the toner container 32Y, spherical toner having an average peround of equal to or more than 0.90 is used. Such spherical toner is excellent in fluidity because of its shape. Therefore, the toner supply path, such as the tube 71, is not clogged, and the toner can be efficiently and reliably conveyed.

The peround of a toner particle is defined by the following equation:

peround=(perimeter length of a circle having an area identical to a projected area of a particle)/(perimeter length of a particle projection image)

Therefore, when the peround is 1.00, the toner particle has a perfectly spherical shape. The average peround can be measured typically by using the flow particle image analyzer FPIA-2100 (manufactured by Sysmex Corporation).

Figure 9:
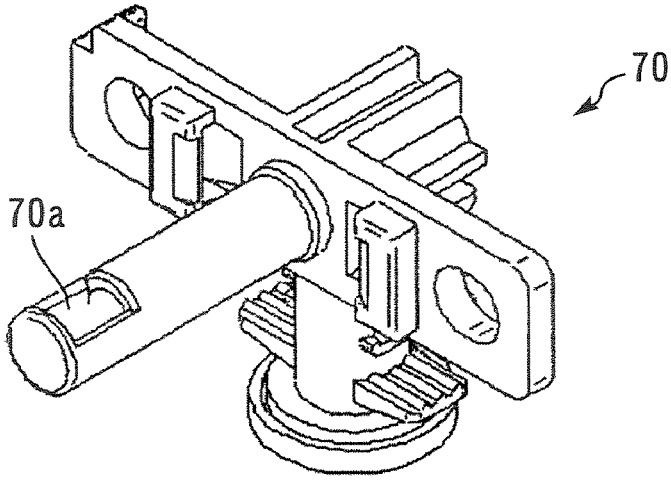
FIG. 9 is a perspective view of a nozzle shown in FIG. 3.

Next, with reference to FIGS. 8 and 9, the configuration near the holding portion 73 of the toner supply device 31 is described.

With reference to FIG. 8, the toner supply device 31 has mounted thereon the sliding surface 31*a* where the sliding portion of the held portion of each of the four toner containers 32Y, 32M, 32C, and 32K slides, the holding portion 73 that defines the position of the holder 34*c* of the held portion, the nozzle 70, the driving unit for transmitting a rotational driving force to the container portion 33Y, the substrate 74, paired arms 80 that press the held portion 34Y toward the holding portion 73 in conjunction with the attaching operation of the toner container 32Y, the lever (pressing portion) that presses the plug member 34*d* in the direction of closing the toner outlet B of the toner container 32Y, and other components.

The holding portion 73 unrotatably holds the held portion of each of the toner containers 32Y, 32M, 32C, and 32K. The holding portion 73 includes a sliding surface abutting on the holder 34*c*, an abutting surface that abuts on part of the cap cover 34*b*, and others. On the sliding surface (side surface) of the holding portion 73 is arranged the positioning member 31*c* that performs positioning in conjunction with the mounting operation of the held portion 34Y (as shown in FIG. 5). The positioning member 31*c* is a convex portion extending along the direction of attaching and removing the toner container 32Y.

The holding portion 73 has mounted therein the nozzle 70 shown in FIG. 9 for each color. The nozzle 70 includes a toner supply opening 70*a* communicating with the toner outlet B formed on the held portion 34Y of the toner container 32Y.

Figure 10:
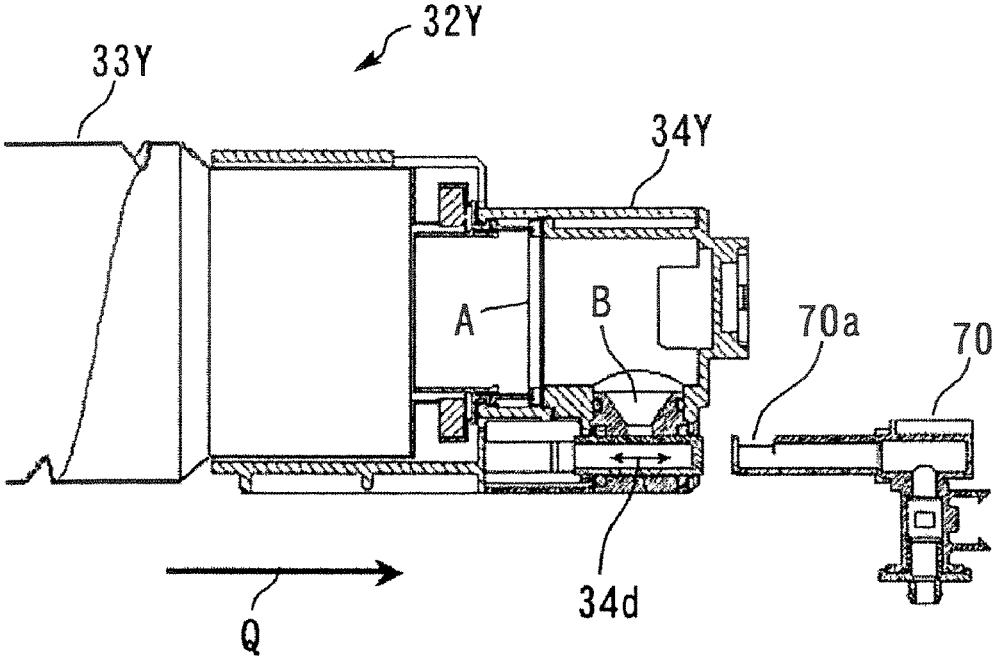
FIG. 10 is a schematic for explaining a state of mounting the toner container on the toner supply device.
Figure 11:
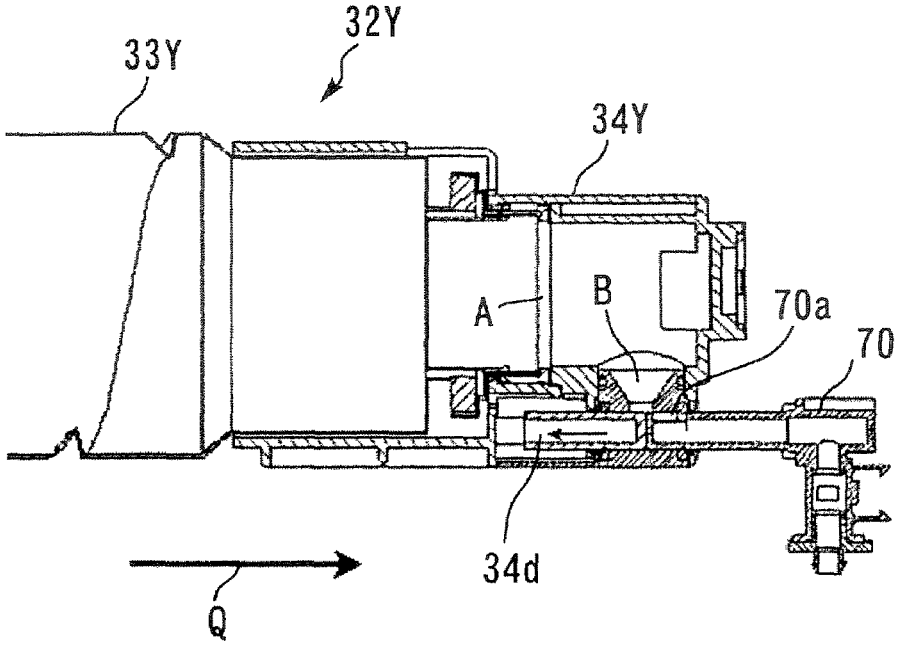
FIG. 11 is another schematic for explaining the state of mounting the toner container on the toner supply device.
Figure 12:
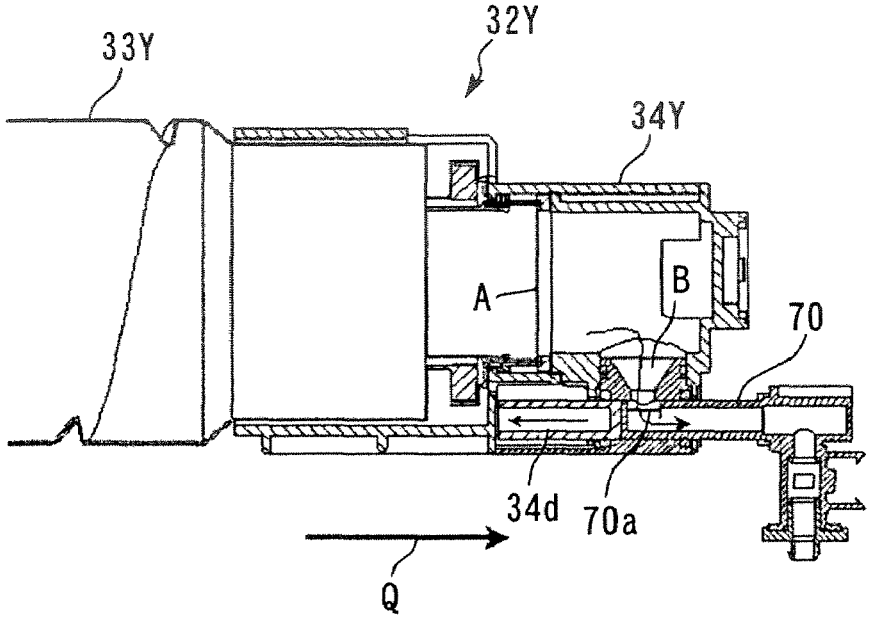
FIG. 12 is a schematic for explaining a state where the toner container has been mounted on the toner supply device.

With reference to FIGS. 10 to 12, the operation of attaching and removing the toner container 32Y to and from the toner supply device 31 is described.

FIG. 10 is a schematic for explaining a state of mounting the yellow toner container 32Y on the toner supply device 31 (in a direction represented by an arrow Q), when viewed in a longitudinal direction. FIG. 11 is a schematic for explaining the state in which the mounting of the toner container 32Y proceeds (the state in which the toner outlet B is further opened), when viewed in a longitudinal direction. FIG. 12 is a schematic for explaining a state where the toner container 32Y has been mounted on the toner supply device 31 (the state in which opening of the toner outlet B has been completed), when viewed in a longitudinal direction.

When the toner container 32Y is mounted on the toner supply device 31 of the image forming apparatus 100, a cover (not shown) on the front surface of the image forming apparatus 100 (the front side in FIG. 1) is first opened to expose part of the toner supply device 31.

Then, with reference to FIG. 10, the toner container 32Y is pressed toward the toner supply device 31 (in the arrow Q direction). That is, the toner container 32Y is mounted on the toner supply device 31 along a longitudinal direction of the container portion 33Y (or the toner container 32Y) so that the held portion 34Y is at the head of the container portion 33Y.

With the sliding portion 34*c*1 sliding on the sliding surface 31*a* of the toner supply device 31 at the head of the toner container 32Y, the toner container 32Y is pressed into the toner supply device 31 in a balanced manner by the user holding the grip portion 33*d* at the rear end of the toner container 32Y.

Then, when the holder 34*c* of the container 33Y reaches the holding portion 73 of the toner supply device 31, in addition to the sliding of the first sliding portion 34*c*1 on the sliding surface 31*a*, the second sliding portion 34*c*2 slides on another sliding surface (side surface) to start positioning of the held portion 34Y. Specifically, an engagement between the engaging portion 34*g* of the held portion 34Y and the positioning member 31*c* of the toner supply device 31 is started.

Then, as the operation of mounting the toner container 32Y proceeds, with the engaging portion 34*g* and the positioning member 31*c* being engaged with each other, the toner outlet B is started to be opened by the plug member 34*d* (as shown in FIG. 11). That is, as the tip of the nozzle 70 is inserted in a hole of the holder 34*c*, the plug member 34*d* is pressed by the nozzle 70. At this time, by the paired arms 80, the held portion 34Y of the toner container 32Y is pressed toward the holding portion 73 (in the arrow Q direction).

Then, with reference to FIG. 12, the position of the held portion 34Y is defined by a position where the holder 34*c* bumps onto the holding portion 73 (bump reference position). At the same time, the plug member 34*d* completely opens the toner outlet B, and also the gear 33*c* of the toner container 32Y engages with the driving gear of the driving unit of the toner supply device 31. The ID chip 35 faces the substrate 74 at a position allowing wireless communication. Then, the toner outlet B of the toner container 32Y and the toner supply opening 70*a* of the nozzle 70 are communicated with each other. Thus, mounting of the toner container 32Y is completed.

Also, when the toner container 32Y is taken out (dismounted) from the toner supply device 31 of the image forming apparatus 100, the procedure is performed in reverse to the mounting procedure described above. In conjunction with the operation of dismounting the toner container 32Y from the holding portion 73, the nozzle 70 is also dismounted from the holder 34*c* to move a position causing the plug member 34*d* to close the toner outlet B by the pressing force of the lever (pressing portion).

In this manner, with one action of the sliding portion 34*c*1 of the toner container 32Y sliding on the sliding surface 31*a* (except for an operation of opening or closing the door), the operation of dismounting the toner container 32Y is completed.

The toner container 32Y according to the embodiment includes the held portion 34Y with the toner outlet B toward downward in a vertical direction. The toner outlet B is arranged below the opening A in the vertical direction. Also, after the plug member 34*d* is reliably positioned in conjunction with the mounting operation, the toner outlet B sealed by the gasket 34*e* by pressing the nozzle 70 is opened. Therefore, toner smudge on the toner outlet B is decreased, and inconveniences of polluting the user with the toner by making contact with the toner outlet B can be suppressed.

The operation of attaching and removing the toner container 32Y to and from the toner supply device 31 forms one action in association with sliding of the sliding portion 34*c*1. Therefore, operability and workability at the time of replacing the toner container 32Y is increased. In particular, with the provision of the sliding portion 34*c*1 on the bottom of the held portion 34Y, the sliding portion 34*c*1 slides on the sliding surface 31*a* while supporting the toner container 32Y.

In the operation of mounting the toner container 32Y, with the user directly holding the grip portion 33*d*, the sliding of the sliding portion 34*c*1 is started. Positioning of the held portion 34Y is started together with the pressing by the paired arms 80. The nozzle 70 is started to be inserted. Then, at the completion of sliding, positioning of the held portion 34Y, insertion of the nozzle 70, and connection of the driving unit are completed. While the held portion 34Y is sliding (a one-action mounting operation), the user can feel the sense of clicking from the positioning of the held portion 34Y, thereby ensuring that no erroneous operation occurs in the mounting operation.

The toner container 32Y is attached and removed to and from the toner supply device 31 (of the image forming apparatus 100) not from above but from the front. Therefore, flexibility in layout of the upper portion of the toner supply device 31 is increased. For example, even if a scanner (document reading unit) is arranged straight above the toner supply device, operability and workability in attaching and removing the toner container 32Y are not decreased. Further, flexibility in layout of an engaging position D between the gear 33*c* of the toner container 32Y and the driving gear of the image forming apparatus 100 is also increased.

Because the toner container 32Y is mounted with its longitudinal direction being taken as the horizontal direction on the image forming apparatus 100, the amount of toner in the toner container 32Y can be increased without affecting the layout in a height direction of the entire image forming apparatus 100. Thus, it is possible to reduce the number of times of replacing the toner container.

Figures 13, 14:
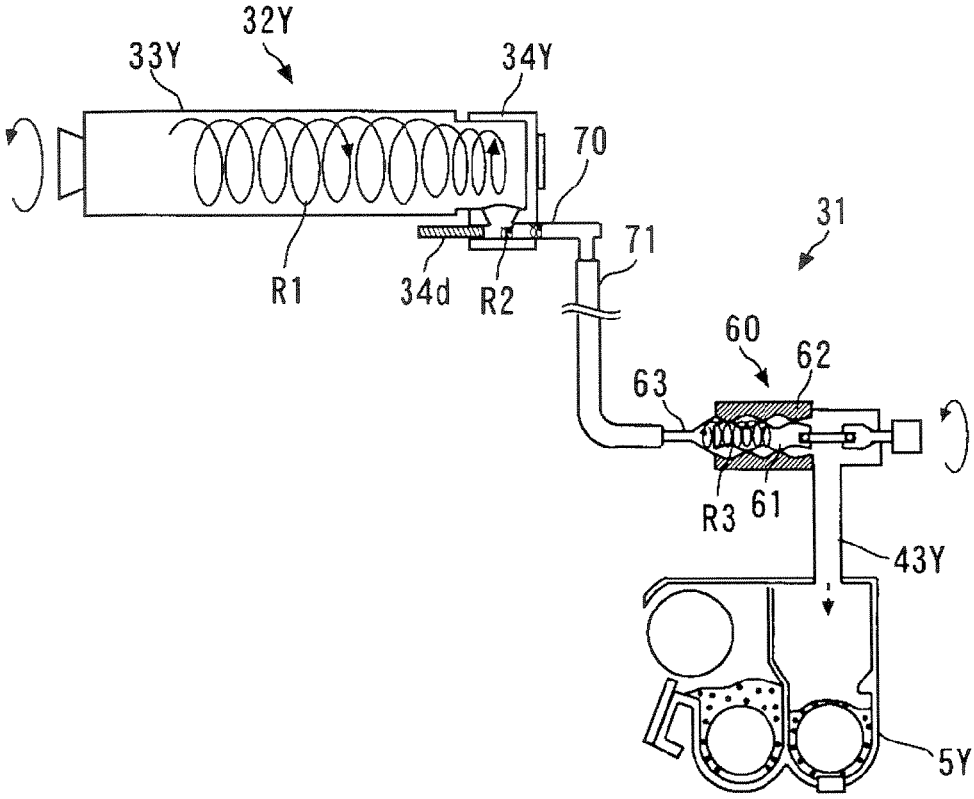
FIG. 13 is a schematic of a vortex flow occurring in the toner supply path shown in FIG. 3.
FIG. 14 is a graph of experimental results for respective experimental conditions.

With reference to FIG. 13, the configuration and operation characteristics in the embodiment are described below.

In the embodiment, the toner container 32Y is configured in a manner such that, in conjunction with the rotation of the container portion 33Y with the protrusion 33*b* as a spiral member being integrally formed, the toner in the container portion 33Y is delivered toward the opening A. Also, this toner container 32Y is mounted on the toner supply device 31 using the screw pump 60.

With such a configuration, a vortex flow (delivery flow) generated in the toner container 32Y through the rotation of the container portion 33Y has superposed thereon a vortex flow (suction flow) generated in the screw pump through the rotation of the rotor 61, which increases toner conveying ability in the tube 71 (conveyor tube).

In particular, the embodiment, the rotating direction of the vortex flow (a flow R1 in FIG. 13) in the toner container 32Y coincides with the rotating direction of the vortex flow (a flow R3 in FIG. 13) in the screw pump 60 (in the embodiment, a right-handed direction). Therefore, the vortex flow in the same rotating direction in the toner supply path is efficiently generated, which further increases toner conveying ability in the tube 71.

Specifically, the spiral direction (winding direction) of the rotor 61 and its rotating direction are set to coincide with the spiral direction (winding direction) of a protrusion (spiral member) 33*b* formed on the container portion 33Y and its rotating direction. In the embodiment, the number of rotations of the container portion 33Y is set to 46 revolutions per minute and, in synchronization with rotational driving of the rotor 61, and the container portion 33 is controlled to be rotatingly driven at 500 milliseconds.

Besides, in the embodiment, the held portion 34Y in the toner container 32Y has formed therein an approximately cylindrical hollow, and also the toner delivery path to the toner outlet B is formed in a mortar shape. Thus, a vortex flow R1 generated in the container portion 33Y through the rotation of the container portion 33Y is maintained without being lost even in the held portion 34Y, which generates a vortex flow R2 toward the tube 71 in an excellent condition even in the nozzle 70.

Further, in the embodiment, a relation represented by the following equation holds:

$$2.8 \leqq (D \times P \times R)/(d \times p \times r) \leqq 4.0 \quad (1)$$

where d is an outer diameter (millimeters) of the rotor 61, p is a spiral pitch (millimeters) of the rotor 61, r is the number of rotations (revolutions per minute) of the rotor 61, D is an outer diameter (millimeters) of the container portion 33Y, P is a spiral pitch (millimeters) of the container portion 33Y, and R is the number of rotations (revolutions per minute) of the container portion 33Y.

Consequently, an excellent balance can be achieved between the vortex flow generated in the toner container 32Y and that in the screw pump 60, which reduces variations in the toner supply amount in the toner supply device 31 (toner conveying ability).

FIG. 14 depicts results of an experiment in which variations in the toner supply amount in the toner supply device 31 (toner conveying ability) were measured, with a balance K (=(D×P×R)/(d×p×r)) of the vortex flow in Equation 1 being set within a range of 2.4 to 4.4.

In FIG. 14, GOOD indicates that variation in the toner supply amount is less than ±10 percent, and the toner conveying ability is at an excellent level. ACCEPTABLE indicates that variation in the toner supply amount is less than ±30 percent, and the toner conveying ability is at an acceptable level. POOR indicates that variation in the toner supply amount is equal to or more than ±30 percent, and the toner conveying ability is at a non-acceptable level.

From FIG. 14, it can be seen that variations in toner supply amount (toner conveying ability) in the toner supply device 31 are reduced when the balance K of the vortex flow satisfies the relation in Equation 1.

As has been described, according to the embodiment, the toner supply device 31 using the screw pump 60 is mounted thereon with the toner container 32Y that conveys toner therein toward the opening A in conjunction with the rotation of the spiral member (protrusion 33*b*). Therefore, the vortex flow generated in the screw pump 60 is superimposed on the vortex flow generated in the toner container 32Y. Thus, it is possible to allow for relatively high layout flexibility, and efficiently and reliably convey toner without clogging the tube 71 even under a high-temperature and high-humidity environment.

While, in the embodiment, each of the toner containers 32Y, 32M, 32C, and 32K contains only the toner, in the case of an image forming apparatus that supplies a two-component developer including toner and carrier to the developing device, the toner containers 32Y, 32M, 32C, and 32K can contain the two-component developer. In this case, the same effects as described above can be achieved.

In the embodiment, the spiral protrusion 33*b* integrally formed on the inner circumferential surface of the container portion 33Y is used as a spiral member. Alternatively, a coil or screw rotatably held inside the container portion 33Y can be used as a spiral member. In such a case, the container portion 33Y is not rotated, but the coil or screw is rotatingly driven by the gear 33*c*. The toner container 32Y conveys toner therein toward the opening A in conjunction with the rotation of the coil or screw. Thus, the same effects as described above can be achieved.

Additionally, in the embodiment, the toner supply device 31 has mounted thereon the suction screw pump 60 for sending gas into the tube 71. Alternatively, the toner supply device 31 can have a discharge screw pump for evacuating gas inside the tube 71. In this case, the same effects as described above can also be achieved.

The present invention is not restricted to the embodiment, but can be changed and modified within the scope of the present invention. The numbers, positions, and shapes of the components described above are cited merely by way of example and without limitation.

As set forth hereinabove, according to an embodiment of the present invention, a toner supply device using a screw pump is mounted thereon with a toner container that conveys toner therein toward an opening in conjunction with the rotation of a spiral member. Therefore, a vortex flow generated in the screw pump is superimposed on a vortex flow generated in the toner container. Thus, it is possible to allow for relatively high layout flexibility, and efficiently and reliably convey toner without clogging of a conveyor tube, even under a high-temperature and high-humidity environment.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising a toner supply device that conveys toner to a conveyance destination, wherein the toner supply device includes:

a toner container that includes a container member with a spiral member therein and an opening, and conveys toner contained in the container member toward the opening in conjunction with a rotation of the spiral member;

a conveyor tube through which the toner discharged from the toner container is conveyed with gas; and a screw pump that sends the gas into and evacuates the gas from the conveyor tube, wherein a rotating direction of a vortex flow generated inside the screw pump coincides with a rotating direction of a vortex flow inside the container member generated by the rotation of the spiral member.

2. The image forming apparatus according to claim 1, wherein the spiral member is a spiral protrusion on an inner surface of the container.

3. An image forming apparatus comprising a toner supply device that conveys toner to a conveyance destination, wherein the toner supply device includes:

a toner container that includes a container member with a spiral member therein and an opening, and conveys toner contained in the container member toward the opening in conjunction with a rotation of the spiral member;

a conveyor tube through which the toner discharged from the toner container is conveyed with gas; and a screw pump that sends the gas into and evacuates the gas from the conveyor tube, wherein the spiral member is a spiral protrusion on an inner surface of the container, wherein the screw pump includes a rotor, and with respect to a toner conveying direction, a spiral direction and a rotating direction of the rotor coincide with a spiral direction and a rotating direction of the spiral protrusion.

4. The image forming apparatus according to claim 3, wherein the screw pump satisfies $$2.8 \leqq (D \times P \times R)/(d \times p \times r) \leqq 4.0$$

where d is an outer diameter of the rotor, p is a spiral pitch of the rotor, r is number of rotations of the rotor, D is an outer diameter of the container member, P is a spiral pitch of the container member, and R is number of rotations of the container portion.

5. The image forming apparatus according to claim 1, wherein the toner container includes a toner-discharging portion with a toner outlet that discharges toner from the opening of the container member through the toner outlet; and an opening-and-closing member that opens and closes the toner outlet, the toner supply device further includes a holding portion that unrotatably holds the toner-discharging portion, and the conveyor tube includes a nozzle that presses the opening-and-closing member in conjunction with an operation of mounting the toner container to open the toner outlet and is connected to the toner outlet.

6. The image forming apparatus according to claim 5, further comprising a biasing portion that biases the opening-and-closing member in a direction against a direction in which the opening-and-closing member is pressed by the nozzle.

7. The image forming apparatus according to claim 5, wherein the toner-discharging portion includes a toner discharge path in a mortar shape to the toner outlet.

8. A toner container that is removably mounted on a toner supply device of an image forming apparatus, the toner container comprising:

a container member that includes a spiral member and an opening, and conveys toner contained therein toward the opening in conjunction with a rotation of the spiral member, wherein the toner supply device includes a conveyor tube through which the toner discharged from the toner container is conveyed with gas; and a screw pump that sends gas into and evacuates gas from the conveyor tube, wherein a rotating direction of a vortex flow inside the container member generated by the rotation of the spiral member coincides with a rotating direction of a vortex flow generated inside the screw pump.

9. The toner container according to claim 8, wherein the spiral member is a spiral protrusion on an inner surface of the container.

10. A toner container that is removably mounted on a toner supply device of an image forming apparatus, the toner container comprising:

a container member that includes a spiral member and an opening, and conveys toner contained therein toward the opening in conjunction with a rotation of the spiral member, wherein the toner supply device includes a conveyor tube through which the toner discharged from the toner container is conveyed with gas; and a screw pump that sends gas into and evacuates gas from the conveyor tube, wherein the spiral member is a spiral protrusion on an inner surface of the container, wherein the screw pump includes a rotor, and with respect to a toner conveying direction, a spiral direction and a rotating direction of the spiral protrusion coincide with a spiral direction and a rotating direction of the rotor.

11. The toner container according to claim 10, wherein the toner container satisfies $$2.8 \leqq (D \times P \times R)/(d \times p \times r) \leqq 4.0$$

where D is an outer diameter of the container member, P is a spiral pitch of the container member, R is number of rotations of the container member, d is an outer diameter of the rotor, p is a spiral pitch of the rotor, and r is number of rotations of the rotor.

12. The toner container according to claim 8, further comprising:

a toner-discharging portion with a toner outlet that discharges toner from the opening of the container member through the toner outlet; and an opening-and-closing member that opens and closes the toner outlet, wherein the toner supply device further includes a holding portion that unrotatably holds the toner-discharging portion, and the conveyor tube includes a nozzle that presses the opening-and-closing member in conjunction with an operation of mounting the toner container to open the toner outlet and is connected to the toner outlet.

13. The toner container according to claim 12, wherein the toner supply device further includes a biasing portion that biases the opening-and-closing member in a direction against a direction in which the opening-and-closing member is pressed by the nozzle.

14. The toner container according to claim 12, wherein the toner-discharging portion includes a toner discharge path in a mortar shape to the toner outlet.

15. An image forming apparatus comprising toner supply means for conveying toner to a conveyance destination, wherein the toner supply means includes toner containing means, including a container member with a spiral member therein and an opening, for conveying toner contained in the container member toward the opening in conjunction with a rotation of the spiral member;

conveyor tube means for conveying the toner discharged from the toner container with gas; and screw pump means for sending the gas into and evacuating the gas from the conveyor tube means, wherein a rotating direction of a vortex flow generated inside the screw pump means coincides with a rotating direction of a vortex flow inside the container member generated by the rotation of the spiral member.

* * * * *